US006439128B1

(12) United States Patent
Miller et al.

(10) Patent No.: US 6,439,128 B1
(45) Date of Patent: Aug. 27, 2002

(54) TERMINAL DESIGN

(75) Inventors: Douglas J. Miller, Oakville; Alan O. Parry, Mississauga, both of (CA)

(73) Assignee: Canadian Pacific Railway Company, Calgary ( * ) Notice: Subject to any disclaimer, the term of this patent is extended or adjusted under 35 U.S.C. 154(b) by 0 days.

(21) Appl. No.: 09/579,557

(22) Filed: May 26, 2000

(51) Int. Cl.[7] ..... B61B 1/00; E01F 1/00
(52) U.S. Cl. ..... 104/27; 104/29
(58) Field of Search ..... 104/27, 28, 29

(56) References Cited

U.S. PATENT DOCUMENTS

| | | | | | |
|---|---|---|---|---|---|
| 3,215,090 | A | * | 11/1965 | Gibbs, Sr. | 104/27 |
| 3,889,603 | A | * | 6/1975 | Harada | 104/26 |
| 4,190,393 | A | * | 2/1980 | Landow | 414/333 |
| 4,238,241 | A | * | 12/1980 | Schneider | 106/281 R |
| 4,765,772 | A | * | 8/1988 | Benedetti et al. | 404/77 |
| 4,973,206 | A | * | 11/1990 | Engle | 410/67 |
| 5,067,872 | A | * | 11/1991 | Engle | 414/786 |
| 5,246,081 | A | * | 9/1993 | Engle | 180/19.2 |
| 5,485,369 | A | | 1/1996 | Nicholls et al. | |
| 5,511,899 | A | * | 4/1996 | Pavelek, II | 404/31 |
| 5,712,789 | A | | 1/1998 | Radican | |
| 5,751,973 | A | * | 5/1998 | Hassett | 395/213 |
| 5,781,892 | A | | 7/1998 | Hunt et al. | |
| 6,186,700 | B1 | * | 2/2001 | Omann | 404/79 |

FOREIGN PATENT DOCUMENTS

| | | |
|---|---|---|
| CA | 2174189 | 10/1996 |
| DE | 4446684 | 6/1996 |
| EP | 0523820 | 1/1993 |
| GB | 2304953 | 3/1997 |
| JP | 11175894 | 7/1999 |
| WO | 96/13015 | 5/1996 |
| WO | 98/18250 | 4/1998 |
| WO | 98/39192 | 9/1998 |

* cited by examiner

*Primary Examiner*—Stephen T. Gordon
*Assistant Examiner*—Greg Blankenship
(74) *Attorney, Agent, or Firm*—Schwegman, Lundberg, Woessner & Kluth, P.A.

(57) ABSTRACT

A railway terminal having a parking area, an access restriction system adjacent to the parking area and a railroad track adjacent to the parking area. The access restriction system limits access to said parking area. The railroad track includes a first section, a second section and a loading pad, wherein the first and the second sections each accommodate a plurality of intermodal railcars, each railcar designed to transport a truck trailer, wherein the first section is coupled to a main rail line. The loading pad links the first section of the railroad track to the second section of the railroad track. The loading pad is designed to support tractor-trailers.

55 Claims, 4 Drawing Sheets

TERMINAL DESIGN

CROSS REFERENCE TO RELATED CASES

This application is related to the following commonly assigned, co-pending application:

Application Ser. No. 09/579,918, entitled "SYSTEM AND METHOD FOR RAIL TRANSPORT" and filed May 26, 2000. That application is incorporated herein by reference.

TECHNICAL FIELD

The present invention is related to intermodal transportation, and more particularly to a system and method of controlling the transport of truck trailers over a railway system.

BACKGROUND INFORMATION

Conventional intermodal terminals have long delays in processing tractor-trailers into the rail yard for transport of the trailers via rail. Typically there is a bottleneck at the access point. As tractor-trailers arrive at the rail yard, they wait in line as each tractor-trailer is manually checked-in. The access point personnel records all of the transport information required for shipping, to include trailer (size, type, etc.), billing information, details regarding the shipment, such as destination, weight, commodity code, commodity description, package type, broker, actual shipper, actual consignee or the like. Each tractor-trailer is checked-in on a first come first serve basis and is not guaranteed a spot on a particular train. Due to the long delays at the access point truckers are required to wait sometimes for over an hour while transport vehicles ahead of them are checked-in and then another hour while they are checked-in. Once processed in the driver drops the trailer off in a designated area and departs, in most cases, without an assurance that the trailer will depart on the next train.

When picking up a trailer the driver again has to wait in a queue consisting of other pick-up and drop-off transports for check-in. Since the trucking companies who own the trailers are not assured transport on a particular train tractor-trailer drivers are often required to wait for the train which is transporting the trailer they are picking up to arrive. The time spent dropping off and picking up trailers becomes a waste of resources for both the trucking companies and the independent tractor-trailer drivers.

Once the trailers are checked-in and dropped-off they are ready to be loaded onto the trains. The process of loading and unloading trains with trailers is not only time-consuming but also labor intensive and costly. Conventional intermodal terminals are built to support cranes or other heavy lifting equipment used to lift the trailers onto rail cars. The infrastructure of the rail terminal is reinforced in order to support the weight of the crane or lifting equipment in operation. The crane or lifting equipment as well as the added infrastructure needed in order to operate the equipment is very costly. In addition, the process of lifting the trailers can easily damage the trailers as most trailers are not designed with lift capabilities and the stress of lifting the trailer weakens the structure of the trailer. Often the trailers are damaged beyond repair after just two lifts.

In addition to damage from lifting, trailers incur damage during transport due to poor suspension of rail cars and the amount of slack between rail cars. Traditionally rail cars have little to no suspension and causes damage to cargo. With little or no shock absorption, cargo and rail car structures are basically absorbing the energy transmitted from the constant movement on the rails. In addition, the slack between rail cars allows a significant amount of movement between rail cars in particular when negotiating curves. The movement due to slack causes the trailers to "sway" on the rail cars and produces additional stress on the trailer structure. As a result of the lack of suspension and the design of current rail cars transportation of trailers via rail results in significant costs due to trailer repair and cargo damage. What is needed is an efficient way to transport trailers via rail without expensive equipment and damage to the trailers and cargo.

After arrival at a terminal, the trains are separated into several sections while being moved onto several parallel tracks. Each section that the train is separated into is placed on one of the several parallel tracks. The process of unhooking train sections from one another and then either pulling or pushing each section onto parallel tracks is time consuming. The trains are then unloaded and loaded in piggyback fashion, only being able to work on alternating parallel tracks at the same time. In order to load and unload the trains in a timely fashion several cranes or other heavy lifting equipment are required. The trailers are then moved to a parking or storage area using moving equipment such as hostlers. The need for heaving lifting equipment, moving equipment, several parallel tracks with a reinforced surface to support the heavy equipment is a substantial investment, which drives up the cost of intermodal transportation significantly. What is needed is a simple inexpensive means to provide intermodal transportation.

Once the unloading is finished and the trailers are moved to an area for pick-up or storage the train is loaded for the next trip. Similar to unloading the lifting equipment and a plurality of crews are employed to load up the train. A significant amount of time is spent loading up the train and then hooking the parallel sections together to form one long train. In order to load or unload several trains at a time the number of tracks increases for each train. For example if each track section can accommodate 15 rail cars then a typical train which transports 60 rail cars requires 4 parallel tracks and each additional train also requires 4 parallel tracks.

The logistics of loading and unloading, for example, four separate trains on sixteen separate tracks is complex. Personnel must make sure the correct sections are on appropriate tracks to assist in optimizing transport to the next destination or pick-up and drop-off. Trains arriving to be loaded and/or unloaded may have to take their place in the queue before dropping rail car sections onto each designated track. The process may also cause logistics problems with other trains using the main rail. For instance, a train using the main rail may be held up waiting for the intermodal train or trains to clear the main line. Or the terminal can be designed with additional rail lines to accommodate the queue of intermodal trains. Such an approach, however, requires additional construction and maintenance and can waste valuable real estate.

Once the rail cars are all loaded the railcars are again tied up hooking the train back together. Currently, the process of hooking the train together involves a number of railway personnel to provide switching for each of the train sections, spotters to insure the train is properly hooked together and engine crew to move the train engine as required. The equipment, land, trained personnel and infrastructure are extremely expensive and these costs drive up the cost of transporting trailers via rail making it an unattractive option for the trucking industry in the short to medium haul arena.

In addition, the unreliability of the trains, time spent waiting for check-in, not to mention damage due to lifting the trailer on and off rail cars as well as damage during transit also contribute to the unattractiveness of the train mode of transportation.

What is needed is a streamlined terminal and method of loading and unloading railway cars and in particular the loading, unloading and transport of trailers via rail.

SUMMARY

The above mentioned problems with intermodal transportation and terminal design are addressed by the present invention and will be understood by reading and studying the following specification.

According to one aspect of the present invention, a railway terminal includes a parking area, an access restriction system adjacent to the parking area and a railroad track adjacent to the parking area. The access restriction system limits access to said parking area. The railroad track includes a first section, a second section and a loading pad, wherein the first and the second sections each accommodate a plurality of intermodal railcars, each railcar designed to transport a truck trailer, wherein the first section is coupled to a main rail line. The loading pad links the first section of the railroad track to the second section of the railroad track. The loading pad is designed to support tractor-trailers.

According to another aspect of the present invention, a railway terminal for use with a main rail line includes an access restriction system, a parking area adjacent to the access restriction system, a railroad track adjacent to the parking area, and a run-around track substantially parallel to the railroad track, wherein the run-around track is coupled to the main rail line at both ends. The railroad track is split into a first section, a second section and a loading pad, wherein the first and second sections each accommodate a train having a plurality of intermodal railcars, where each railcar is designed to transport a truck trailer. The first section is coupled to a main rail line, wherein the loading pad links the first section of the railroad track to the second section of the railroad track and wherein the loading pad is designed to support fully loaded tractor-trailers; and According to yet another aspect of the present invention, a system and method for loading an intermodal train having a plurality of train sections, including a first and a second train section, is described. The intermodal train is positioned on a single track, wherein the single track includes a first section, a second section and a loading pad and wherein the first section is linked to the second section via the loading pad. The first train section is positioned on the first section of the single track. The first train section is separated from the train and the second train section is positioned on the second section of the single track. A first portable ramp is aligned, on the loading pad, with the first train section and a second portable ramp is aligned, on the loading pad, with the second train section. Selected trailers are loaded onto rail cars of the first train section via the first portable ramp. Selected trailers are loaded onto rail cars of the second train section via the second portable ramp. The trailers are secured onto the rail cars of the first and second sections of the train and the first section of the train is coupled with the second section of the train.

According to yet another aspect of the present invention, a system and method of unloading an intermodal train is described. The intermodal train is separated into a plurality of train sections. Each train section is placed adjacent to a loading pad. A hostler truck is driven onto the train via the loading pad. The hostler truck is coupled to a trailer and the trailer is taken off the train. The trailer is then parked in a transfer parking location.

According to yet another aspect of the present invention, an intermodal transportation terminal includes an access restriction system that selectively restricts access to the intermodal transportation terminal, a parking area adjacent to the access restriction system, at least one railroad track adjacent to the parking area and a loading pad. The parking area accommodates a plurality of trailers and provides access to each trailer for pick-up and drop-off. The track includes a plurality of track sections, including a first and a second track section, and is coupled to a main rail line. The loading pad connects the first and second track sections. Trailers are moved across the loading pad when loaded on rail cars positioned on the first and second track sections.

According to yet another aspect of the present invention, an intermodal transportation terminal includes an access restriction system, a parking area, first and second railroad tracks adjacent to the parking area and a loading pad. The first railroad track includes a plurality of track sections, including a first track section and a second track section. The second railroad track is substantially parallel to the first railroad track and includes a plurality of track sections, including a third track section and a fourth track section. The parking area includes a road to rail parking area and a rail to road parking area. The loading pad crosses the first and second railroad tracks and couples the first track section to the second track section and the third track section to the fourth track section. The first railroad track and the second railroad track are each coupled to a main rail line.

According to yet another aspect of the present invention, an intermodal transportation terminal includes an access restriction system, at least one parking area adjacent to the access restriction system and at least one railroad track adjacent to the at least one parking, area, wherein each railroad track is coupled to a main rail line and wherein each railroad track includes a plurality of track sections, including a first track section, a second track section, a third track section and a fourth track section. The terminal also includes a first loading pad coupled between the first and second track sections and a second loading pad coupled between the second and a third track sections. In addition, a run around track runs substantially parallel to the at least one railroad track, wherein the run-around track is coupled to the main rail line.

According to yet another embodiment of the present invention, an intermodal transportation system includes a plurality of terminals, an intermodal train having a plurality of rail cars, wherein each rail car accommodates a trailer; and a truck, wherein the truck moves each trailer onto its respective rail car. Each terminal includes an access restriction system that selectively restricts access to the terminal, a parking area adjacent to the access restriction system, at least one railroad track adjacent to the parking area and a loading pad which interconnects the first and second track sections. The parking area accommodates a plurality of trailers and provides access to each trailer for pick-up and drop-off. The track includes a plurality of track sections, including a first and a second track section and is coupled to a main rail line. Trailers are moved across the loading pad when loaded on rail cars positioned on the first and second track sections.

DETAILED DESCRIPTION

In the following detailed description of the preferred embodiments, reference is made to the accompanying drawings, which form a part hereof, and in which is shown by way of illustration specific embodiments in which the invention may be practiced. It is to be understood that other embodiments may be utilized and structural changes may be made without departing from the scope of the present invention.

Figure 1:
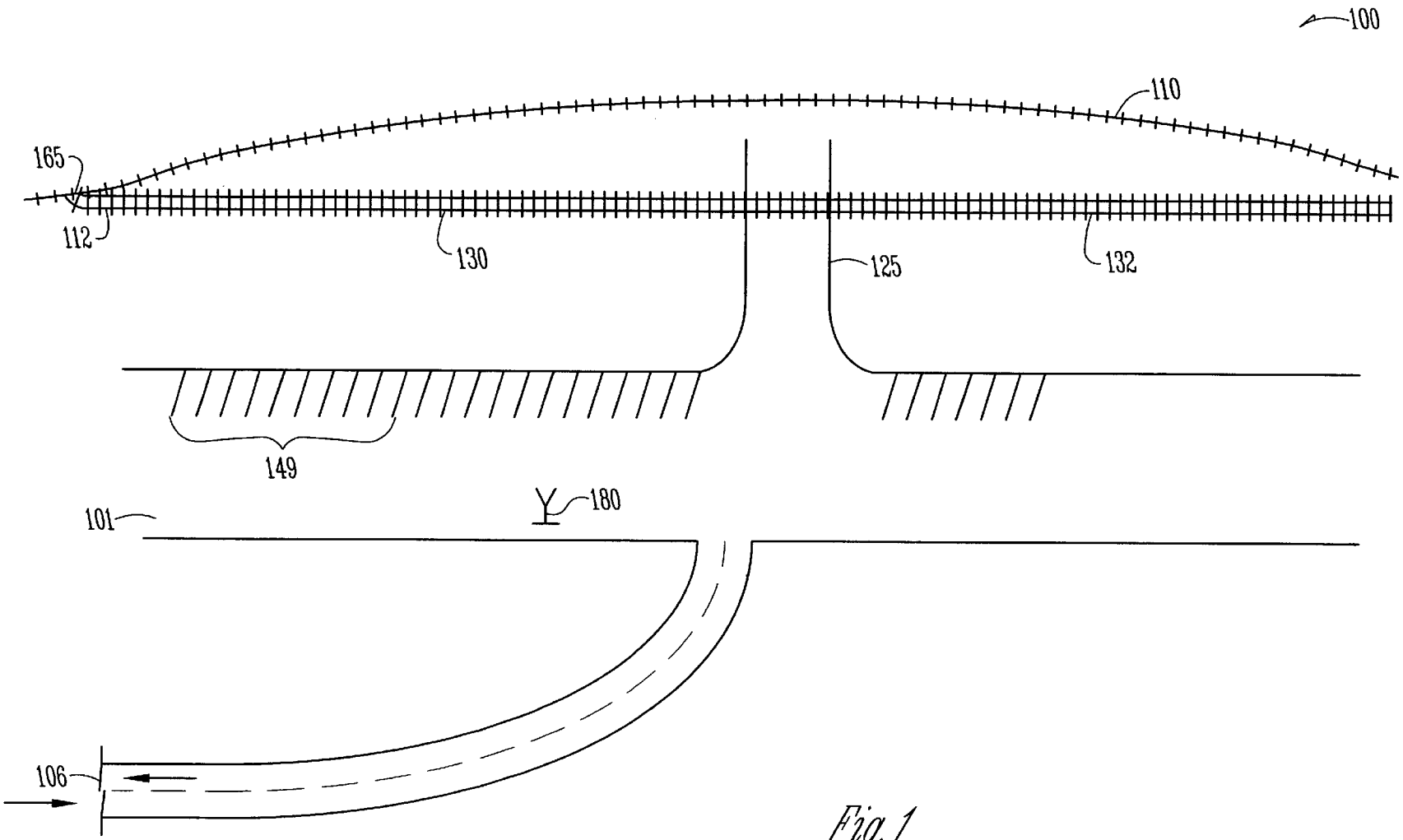
FIG. 1 is an illustration of one embodiment of an intermodal terminal according to the teachings of the present invention.

FIG. 1 is an illustration of one embodiment of an intermodal terminal shown generally at 100 and constructed according to the teachings of the present invention. The intermodal terminal 100 includes a single railroad track (track) 112 having two rail sections 130 and 132 and a single loading pad 125. A train traveling on track 112 passes over loading pad 125 when going from section 130 to section 132, and vice versa.

Intermodal terminal 100 also includes an access restriction system 106 adjacent to a parking area 101. The access restriction system 106 restricts access to and from intermodal terminal 100. Parking area 101 is adjacent to single track 112 and includes parking spaces 149 that accommodate tractor-trailers. In one embodiment, the intermodal terminal 100 further includes a wireless communication system 180 that provides communication capabilities, such as two-way radios, within the intermodal terminal area 100.

In one embodiment, track 112 couples at one end to a main rail line 110 by means of a switch 165. In another embodiment, track 112 couples to the main rail line 110 at both ends of track 112 via switches. In one embodiment, intermodal terminal 100 is designed to accommodate intermodal trains pulling sixty rail cars to enter the rail yard on the single track 112 once the switch 165 is moved into the appropriate position. The engine pulls the train forward until approximately half of the rail cars are situated on the first section 130. Rail personnel disconnect the first half of the rail cars from the train. The engine with the second half of the rail cars pulls further forward until the second half of the rail cars have cleared loading pad 125 and are situated on the second section 132 of the single track 112. The train is now ready to be loaded or unloaded as required.

As noted above, there is a need for a low cost, high-quality, profitable intermodal product for the short-haul, truck competitive market which allows the railway to partner with the trucking industry. Truckers want a simplified business process for their intermodal shipments. They also desire fast terminal throughput.

It is possible to leverage information technology to simplify the intermodal business process. This is desirable not only to eliminate the familiar line-ups at the terminal entry gate, but also to guarantee the delivery of a customer's shipment on a designated train, at a specified time.

In one embodiment, one or more guaranteed slots can be reserved on each intermodal train. (In contrast, conventional intermodal procedures can often result in the customer's container being left behind for the next train.) In one such embodiment, customers use the Internet, phone or fax to reserve a slot on the train using an automated reservation system.

The data confirmed by the customer on the automated reservation system drives the rest of the transport process. When a driver arrives at the terminal, there is no waiting for a clerk to input the details of the shipment at the gate. The data already has been captured on the system prior to the driver's arrival at the facility.

In one embodiment, hand-held portable computers are used to control all terminal operations. The paperless environment created by the hand-held units and the automated reservation system reduces the driver's time in the yard to a fraction of the time spent at a conventional terminal.

In contrast to conventional intermodal terminals, where it is often the case that a trailer is dropped off without any guarantee that it will make it on the next train, such an embodiment guarantees customers a slot on the train. The system's scheduled service assures customers that their freight will arrive consistently on time, regardless or weather or road conditions. This is a major factor in competing with truck only approaches.

In one embodiment, access to the reservation system is through the Internet. Such an approach facilitates business processes with customers, while increasing productivity. Approaches to designing the reservation system are discussed in application Ser. No. 60/136,544, entitled "SYSTEM AND METHOD FOR RAIL TRANSPORT OF TRAILERS" and filed herewith, which discussion is incorporated herein by reference.

Fast terminal throughput times can also be attributed to the simple terminal design and to the business process, which, in one embodiment, are enabled by the hand-held computers used to control everything from trailer check-in, safety inspections of each load, to the departure of the loaded train. The business process is discussed in greater detail in application Ser. No. 60/136,544, entitled "SYSTEM AND METHOD FOR RAIL TRANSPORT OF TRAILERS" and filed herewith, which discussion is incorporated herein by reference.

In one embodiment, each terminal 100 includes at least one set of loading tracks, an office building and a spacious yard for easy maneuvering. In one such embodiment, terminal 100 is designed so as to eliminate the entry gate. The entry gate function is instead performed by the automated reservation system in combination with the handheld computer units.

Instead of lining up and completing paperwork with a clerk at the gate, the driver simply takes an automated ticket and moves into the terminal. By the time the trailer has been dropped off or picked up, the terminal operator has already referenced the shipment data from the automated reservation system and completed the "electronic paperwork" on a hand-held computer. In one embodiment, the driver signs a location on the computer screen, then enters in an exit code on the way out of the terminal.

In one embodiment, each terminal is a long, thin design with multiple loading areas. In a train system using multiple sets of spine cars, one or more sets of spine cars can be separated and loaded using portable loading ramps and hostler trucks operating in parallel.

The innovative use of a wireless network and client-server technology for the operation of the hand-held units enhances the success of this application. In one embodiment, internet access to the automated reservation system is offered to customers who are seeking ways to automate their own business processes.

The automated reservation system means that all data relating to a customer's shipment is already captured prior to their arrival at terminal 100. This data, in turn, drives the rest of the business and operations processes of this intermodal transport embodiment.

In one embodiment, the hand-held computer units and the reservation and tracking system application are used to register a truck's arrival at the terminal; assign the truck's parking space; load the train; perform the air brake inspection; record departure & arrival times; unload the train; accounting systems, and produce management reports. The hand-held computer units and the reservation and tracking system application are discussed in application Ser. No. 60/136,544, entitled "SYSTEM AND METHOD FOR RAIL TRANSPORT OF TRAILERS" and filed herewith, which discussion is incorporated herein by reference.

The elimination of the entry gate is a revolutionary concept from typical intermodal terminals where truckers line up to complete paperwork with a clerk. Such line-ups can sometimes be 10 to 15 trucks long. After completing the paperwork at the intermodal terminal gate, the trucker proceeds into the terminal where he/she can then expect to spend less than 30 minutes delivering his/her trailer.

This is in stark contrast to the present terminal design, where a driver does not wait at the terminal gate but simply presses the button on a ticket dispenser to enter. The driver proceeds to a parking area and is met by a terminal operator who uses a hand-held computer to scan the entry ticket and check-in the trailer. Since the automated reservation system already knows the details of the shipment, the driver does not have to provide any additional information. He/she simply signs the screen of the hand-held unit as a receipt for the trailer, then departs the terminal by inputting an exit code at the departure gate.

The access system employs a leading-edge technical infrastructure to provide the greatest potential for delivering business value and to support the fast-paced business operations. In one embodiment, the system includes five main client-server components including: application server, mainframe systems, client workstations, Web server, mainframe systems, client communicate using a wireless network.

In one embodiment, the central server stores the operational data in a back-end message receiving application. Automated interfaces extend through MQ to Customer billing and train consist mainframe systems.

In one embodiment, customer service representatives access the reservation system through Windows NT workstations to manage reservations, setup operating trains, and track customer shipments. A Web server enables customers to create reservations and track shipments online.

In one embodiment, radio frequency (RF) technology is used to implement a Terminal Management System, a pen-based application running on portable computers, creating a paperless environment to manage terminal operations in the yard.

In one embodiment, an intermodal transportation system includes two or more specially designed terminals 100. Each terminal includes a Token Ring local area network (LAN) that connects the client workstations, the gate system, and the RF network. Access restriction point 106 controls and manages security for the entry and exit gates. In one embodiment, the RF wireless network consists of external access points mounted throughout the yard providing RF coverage for communications with the hand-held units. In one such embodiment, the access points are connected by fiber optic cables to an Ethernet FiberLink HUB, networked to the LAN through a router. The LAN is connected to CPR's computing facility via a router, providing access to the application server and mainframe.

Figure 2:
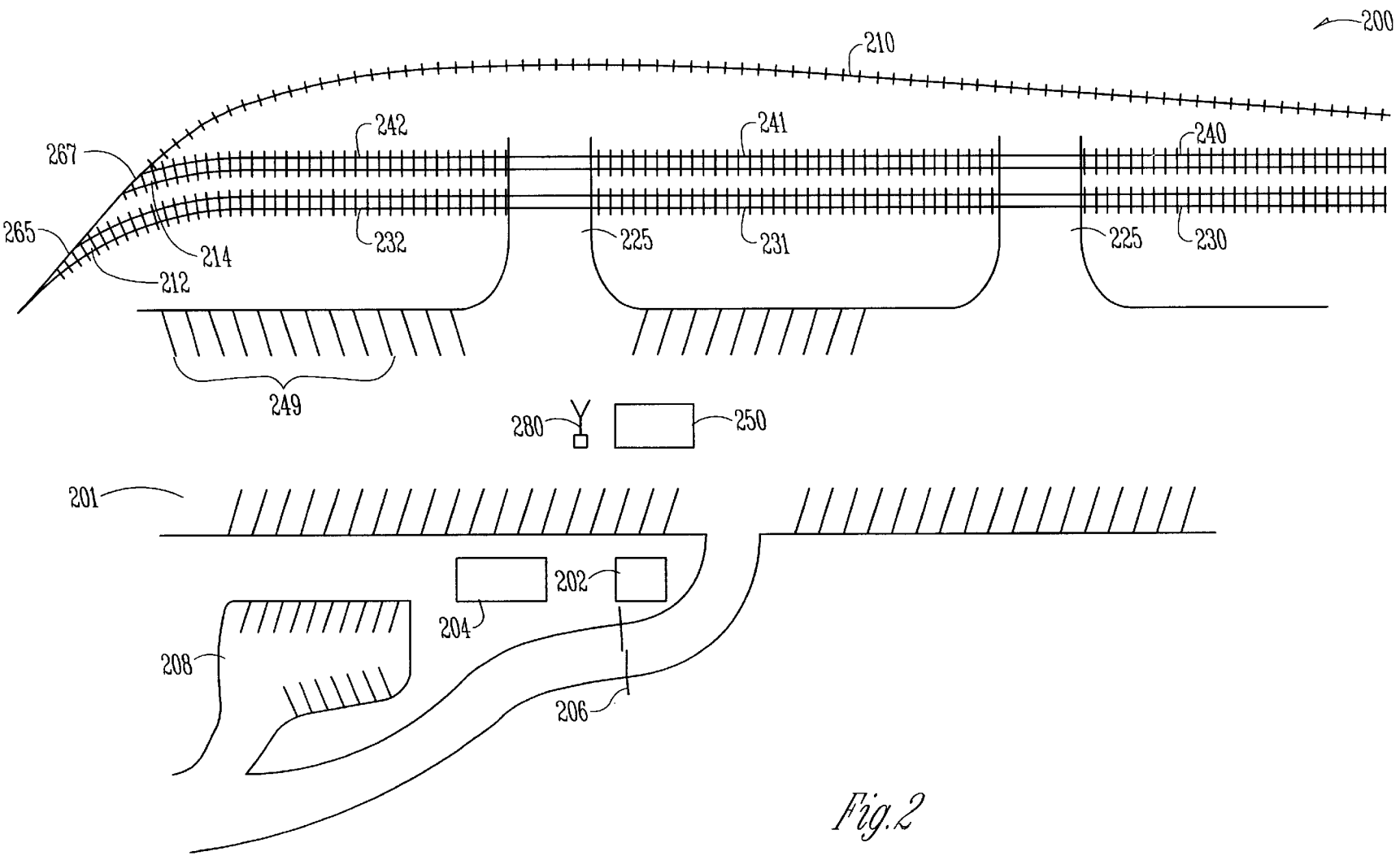
FIG. 2 is an illustration of another embodiment of an intermodal terminal according to the teachings of the present invention.

FIG. 2 is an illustration of another embodiment of an intermodal terminal shown generally at 200 and constructed according to the teachings of the present invention. Terminal 200 includes two tracks 212 and 214 that are substantially parallel to one another. The two tracks 212 and 214 are each split into three sections 230, 231 and 232 and sections 240, 241 and 242, respectively. Each section is connected to an adjacent section by a loading pad 225 to form one long track section 212.

Similarly, sections 240, 241 and 242 are linked together by loading pads 225 to form one long track section 214. In one such embodiment, intermodal terminal 200 includes an access restriction system 206 adjacent to a parking area 201. The parking area is adjacent to the two tracks 212 and 214 and includes parking spaces 249 that accommodate tractor-trailers. In one such embodiment, terminal 200 includes a wireless communication system 280 that provides communication capabilities, such as two-way radio communication, within the intermodal terminal area 200.

Access point 106 and 206 restrict access to intermodal terminals 101 and 201 respectively. In one embodiment, the access point is a gate. Other devices, such as a fence, gate-arm or security camera, can be used. In one embodiment, access points 106 and 206 are automated and activated by any number of activities (e.g., taking a ticket, entering a security code, scanning the vehicle, etc.). Access points 106 and 206 therefore provide added security to the intermodal terminal. In one embodiment, the access point 106 and 206 provides entry and exit restriction. In one embodiment, access point 106 and 206 include the wireless communication system 180 and 280, respectively.

In one embodiment, the two tracks 212 and 214 couple to a main rail line 210 by means of switches 265 and 267 respectively. In another embodiment, the two tracks 212 and 214 couple to the main rail line 210 at both ends of the tracks via switches. In one embodiment, intermodal terminal 200 is designed to accommodate an intermodal train comprising up to 60 rail cars one either one of tracks 212 or 214, respectively. Therefore, the terminal design shown in FIG. 2 can be used to handle two such intermodal trains at a time.

Since tracks 212 and 214 are substantially the same in design only one of the tracks, 212, will be used to describe the process of pulling in and dropping rail cars. The train engine pulls the rail cars forward until approximately the last one-quarter of the rail cars are situated on the first section 232 of track 212. The rail crew disconnects the last quarter of rail cars from the train. The engine then pulls forward so that the middle half of the original 60 rail cars are situated on the second section 231 of track 212. The rail crew disconnects the rail cars from the train at this point and the engine pulls forward past the second loading pad 225 so that the engine and the balance of rail cars are situated on the third section 230 of track 212. In this way a train having 60 rail cars can be split into 3 sections, with the first section comprising 15 rail cars, the second section comprising 30 rail cars and the third section comprising 15 rail cars.

In such an embodiment, loading pads 225 are used to load and unload the train concurrently from the one end of the first and third train sections adjacent to the loading pad 225 and from both ends of the second train section which are adjacent to loading pads 225. In addition, the second track 214 can also accommodate a train having 60 rail cars designed to accommodate trailers. It is understood by those skilled in the art that the train may be split into any number of rail cars based on the length of the train with respect to the track section accommodating that length. Also it is understood that the train may be pulled into the terminal, backed into the terminal or the like. This layout is by way of example and is not intended to restrict the process of disconnecting the rail cars from the train. For example a train having only 10 rail cars may pull into the first section, second section or third section as determined by the rail crew.

In one embodiment, intermodal terminal 200 further includes a way station 250 where truck drivers and rail crew can get out of the elements. The way station may include any number of amenities to include bathroom facilities, vending machines, phones or the like.

In another embodiment, intermodal terminal 200 includes an office building 202 adjacent to the parking area 201. In a further embodiment, intermodal terminal 200 includes a rest facility or barracks 204, adjacent to parking area 201, for the train crew. As the train crew travels from city to city rest and relief facilities become a necessity. In another embodiment, terminal 200 includes a staff/visitor parking area 208 adjacent to parking area 201.

It is understood by those skilled in the art that intermodal terminal layouts 100 and 200 are not restricted to the terminals illustrated with respect to FIGS. 1 and 2. Terminals 100 and 200 may include any number of tracks to accommodate additional capacity and/or may include any number of loading pads appropriate for a particular layout, or the like. For example, in one embodiment, terminal 100 illustrated by FIG. 1, includes an additional track (not shown) that is substantially parallel to track 112 and is linked by loading pad 225. In this embodiment, track 112 and the additional track each include two sections (130 and 132 for track 112) and these sections are each approximately 1000 feet and can accommodate at least 15 rail cars that are designed to transport trailers (intermodal rail cars). In this embodiment, both tracks are coupled to a main line at both ends of each track so that a train can pull into the terminal from a main line and exit the terminal from the other end of the track on the same or different main line.

It should also be noted that, although many of the examples shown throughout this document are based on sixty rail cars split into three or more sections, these concepts can be applied to any size intermodal train. The placement of loading pads will dictate the number of sections that a train will be split into. The size of the sections adjacent to the loading pads will dictate the size of each train section. Finally, although in the examples given the train splits into symmetric sections, in some embodiment, the terrain or other environmental factors may dictate an asymmetric split of each intermodal train.

In operation, a train having 60 intermodal rail cars, upon arrival at the terminal, pulls onto track 112 and moves through on to the main line in order to drop one quarter of the rail cars on section 132. The train then pulls forward and drops a second quarter of the original rail cars on section 130. The train proceeds forward on the main line so as to clear switch 165 and then backs onto the additional parallel track in order to drop a third quarter of original rail cars on the first section of the parallel track. The train pulls forward and positions the engine with the last quarter of the train on the second section of the additional parallel track. Although this terminal design is not optimum as it involves additional time and effort in dropping and picking up the train sections it illustrates the flexibility of the terminal design when faced with a less than optimal terminal size or shape. In particular, for an existing terminal that will not easily accommodate the long thin terminal design described with respect to terminals 100 and 200.

Figure 3:
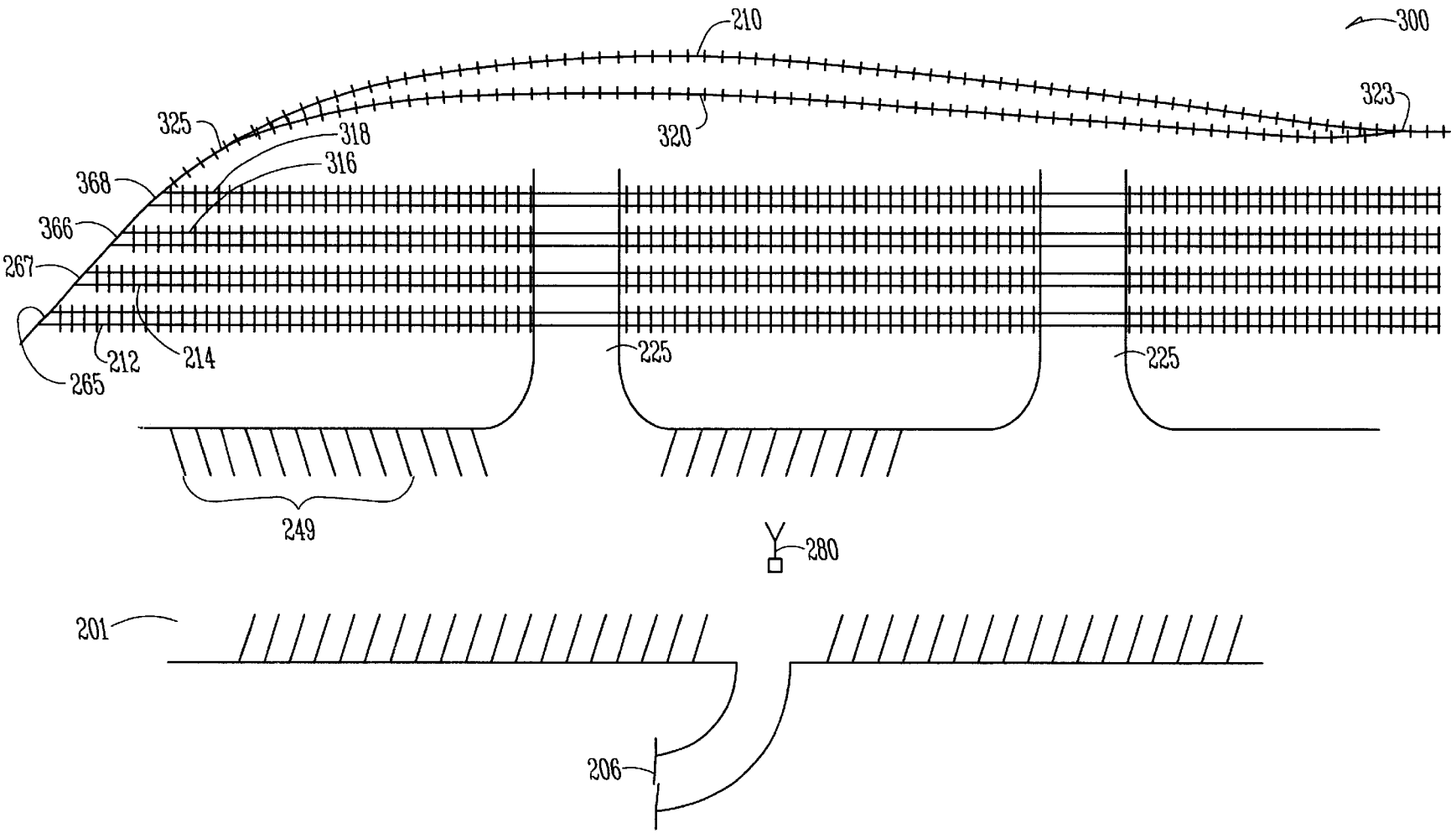
FIG. 3 is an illustration of an alternate embodiment of an intermodal terminal according to the teachings of the present invention.

FIG. 3 is an illustration of one embodiment of an intermodal terminal indicated generally at 300, according to the teachings of the present invention. Intermodal terminal 300 includes the following components as discussed with reference to FIG. 2: a first and a second track 212 and 214, respectively, split into three sections, an access restriction system 206, a wireless communication system 280, a first and second loading pads 225 and a parking area 201 with parking spaces 249. Intermodal terminal 300 further includes additional tracks 316 and 318 linked together by loading pads 225. Tracks 212, 214, 316 and 318 are shown coupled to a main line 210 via switches 265, 267, 366 and 368 respectively. In one embodiment, terminal 300 includes a run-around track, shown as 320 in FIG. 3. The run-around track 320 is coupled at either end to a main line 210 via switches 323 and 325. The run-around track 320 enables trains to enter and exit the terminal on the run-around track without interfering with the loading and unloading of trains on tracks 212, 214, 316 and 318. The run-around track 320 can also be used to park engines, portions of trains or to repair engines, rail cars or the like.

Figure 4:
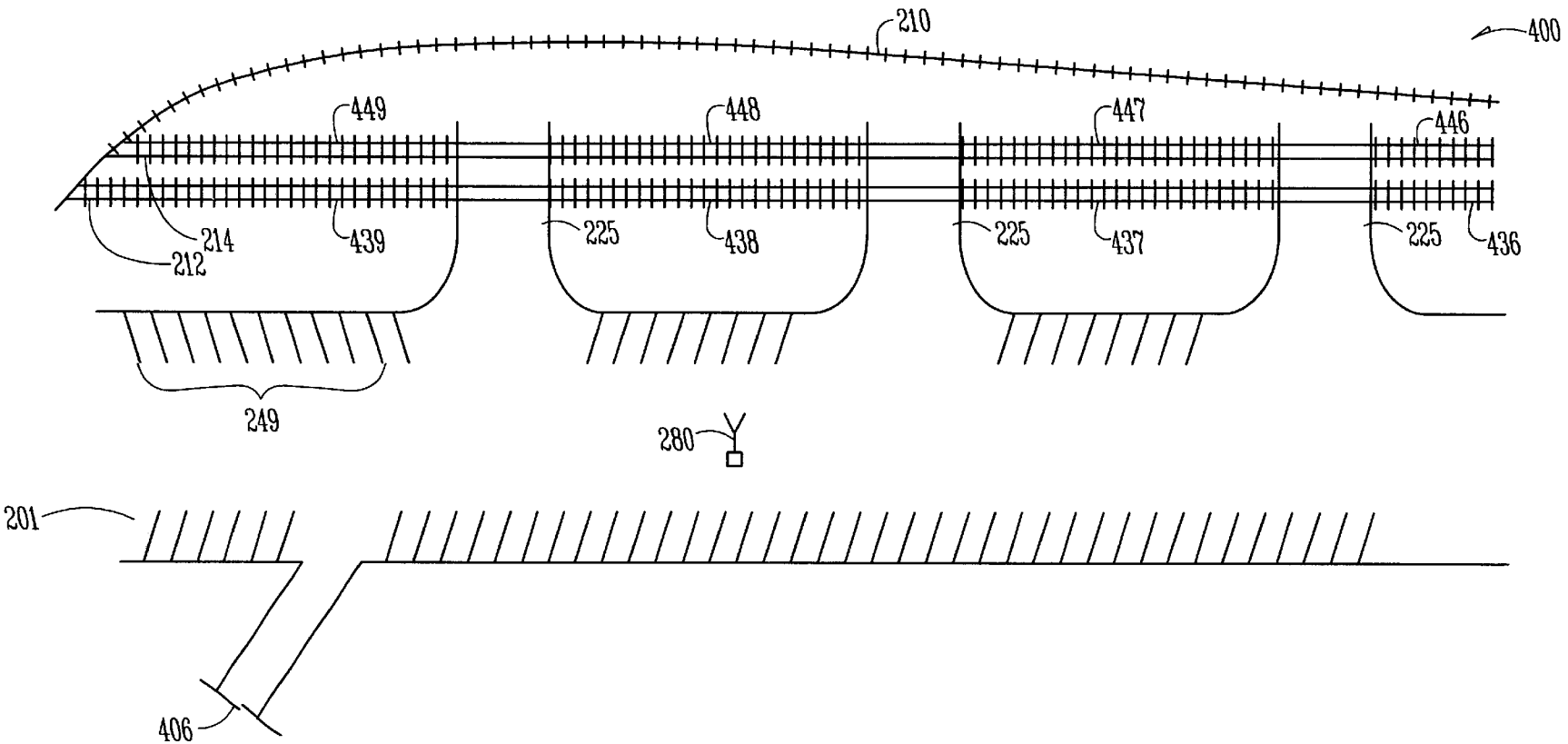
FIG. 4 is an illustration of a further embodiment of an intermodal terminal according to the teachings of the present invention.

FIG. 4 is an illustration of an alternate embodiment of an intermodal terminal shown generally at 400 and constructed according to the teachings of the present invention. Intermodal terminal 400 includes the following components as discussed with reference to FIG. 2; a first and a second track 212 and 214 respectively, an access restriction system 206, a wireless communication system 280 and a parking area 201 with parking spaces 249. Tracks 212 and 214 are coupled to a main line 210 and are linked together by two loading pads 225. In this embodiment, the tracks 212 and 214 are split into four substantially equal sections 436, 437, 438 and 439 and sections 446, 447, 448 and 449, respectively.

In one embodiment, parking areas 101 and 201 include a prepared surface for movement of tractor-trailers with minimal wear or damage to the prepared surface. In order to keep costs down and simplify terminals 100, 200, 300 and 406, gravel or rock in combination with a durable top layer is used as a prepared surface. In one embodiment, the prepared surface comprises a bottom layer of rock and a top layer of recycled asphalt. In another embodiment, the prepared surface comprises a bottom layer of rock and a top layer of crushed concrete. Any type of service preparation which will reduce wear or damage due to constant movement of fully loaded tractor-trailers can be used. On the other hand, one may design parking areas 101 and 201 with little or no surface preparation and just accept the wear. It is understood by one skilled in the art that the parking areas are not limited to the described prepared surfaces and may comprise any combination of materials.

In one embodiment, parking areas 101 and 201 are designed for easy access to and from loading pads 125 and 225, respectively, as well as any railroad tracks adjacent to the parking area. In one such embodiment, parking areas 101 and 201 comprise a road to rail parking area where trailers are dropped off and a rail to road parking area where trailers are parked for pick-up. The parking areas may be arranged in any manner to enable efficient use of the parking area with respect to loading and unloading of trains. In another embodiment, parking areas 101 and 201 are split into discrete sections. For instance, a first section may be used as a rail to rail parking area where trailers arrive by rail and depart by rail. A second section may include a rail to road area while a third section may include a rail to road area. In still a further embodiment, parking areas 101 and 201 include a road to road parking area where customers can park a trailer for pick-up at a later time by the same tractor or by another tractor. In an alternate embodiment, parking areas 101 and 201 include a long term parking area for storage of trailers, equipment, hostler trucks, railway cars or the like.

In one embodiment, loading pads 125 and 225 are no less than 300 feet in width to allow concurrent loading and unloading of both sections of a train that are linked by the same loading pad 125 or 225. In one such embodiment, loading pads 125 and 225 are paved and reinforced for movement of fully loaded trailers onto and off of trains with minimal wear or damage to the pad. In one embodiment, loading pads 101 and 201 are paved using asphalt. In another embodiment, loading pads 101 and 201 are paved using asphalt on top of a reinforced structure. In another embodiment, loading pads 101 and 201 are paved with concrete on top of a reinforced structure. The reinforced structures include concrete forms, metal reinforcing bars in concrete, metal plates, compacted soil, or the like.

In one embodiment, portable ramps are used to aid in loading and unloading the trains. The portable ramps are designed to couple to a hostler truck or other moving device as well as rail cars. In operation, the hostler couples to a portable ramp and positions the ramp for coupling to a rail car. Once the ramp is in position and secured for receipt of trailers, hostler drivers select trains for placement on the train based on destination, type of load, time of pick-up at the destination and the like. The hostler drivers couple a hostler truck to a trailer and drive it onto the train. In one embodiment, each hostler truck with trailer is first positioned at the bottom of a ramp by the hostler truck and then is backed onto the train. The trailer is backed onto the next vacant rail car so as to fill the train from the front to rear. In another embodiment, the hostler with trailer is driven onto the train via a ramp instead of being backed on.

In one embodiment, trailers are unloaded from the rail cars using a trailer moving device such as the hostler truck. First the portable ramps are positioned and coupled to the respective train sections adjacent to the loading pad(s). In one embodiment, one portable ramp is used for the first half of the train and one or more portable ramps are used for the second half of the train. In this embodiment, loading or unloading of the train is capable of being performed concurrently. The trailer-moving device couples together with the trailer, attaches the ramp to the last car of the first or second section of the train and secures it in place. When unloading the rail cars, the trailer moving device travels up the ramp and couples to the first trailer with at least one rail crew member assisting the hostler driver in attaching the trailer and releasing the trailer from the rail car. In one embodiment, the hostler driver releases the trailer from the rail car and employs the release mechanism for a support structure called legs on the rail car. The hostler driver then transfers the trailer from the rail car to the parking area 101.

In one such embodiment, loading pads 125 and 225 are wide enough to accommodate two portable ramps, each connected to a train section on either side of the loading pad as well as concurrent loading and unloading of trailers on both train sections.

In another embodiment, each train section includes a built-in ramp used to load and unload trailers. Loading pads 125 and 225 should be designed to support such ramps when they are lowered to the pad.

In one embodiment, each terminal is a long, thin terminal design with multiple loading pads. In a train system using multiple sets of spine cars, one or more sets of spine cars can be separated and loaded using portable loading ramps and hostler trucks operating in parallel.

In one embodiment, each train includes specially designed intermodal rail cars. Each rail car is designed as part of a "spine." The full train comprises twelve sections of five spine cars. The train is comprised of articulated sections. The five spine cars are joined together in order to minimize slack between cars. The spine cars have bridge sections between the cars to provide a substantially regular surface for the trailers to be driven over. When joined together, a section of five spine cars produces minimal movement between cars. The five car sections move as one unit. Moving as one unit results in less movement of the trailer and the cargo and therefore a reduction of damage to trailers and cargo. In addition, each section of 5 spine cars is joined to another section of five spine cars in order to form a train having 60 rail cars. Each of the sections are joined closely together so as to reduce slack between each of the 5 spine sections this results in maximum flexibility of the train to negotiate curves with minimal movement. Each five spine section is joined to another spine section and includes bridge sections between the spine sections to provide a substantially regular surface for the trailers to be driven on. The result is a 60 car articulated train which operates a continuous surface for loading and unloading and reduces damage to trailers and cargo. In one embodiment, each rail car includes a built-in suspension system that absorbs stresses due to transport. In one embodiment, each rail car is also designed with built-in "legs" to support a fully loaded tractor-trailer. The legs are integral to the rail car and are moved in position after the hostler truck has positioned the trailer onto a rail car. In one embodiment, the built-in legs are part of the suspension system and facilitate absorption of stresses due to transport.

Such a train has many unique features. It is not a train in the conventional sense, but a flexible railway element which bends around curves, therefore it doesn't have the between-car coupler action called "slack." This unique ability to eliminate slack improves the ride and reduces the chances of damaging high-value freight. In addition, by reducing the forces exerted on the trailers, this approach permits the use of rail to transport conventional trailers without modification. In one embodiment, each train includes twelve sets of five-spine cars.

In one embodiment, each train includes a split ramp car which provides two drive-on/drive-off surfaces. Standard highway trailers can be driven on and off the platforms. This compares favorably to conventional intermodal terminal technology where reinforced trailers are hoisted on and off the train using expensive and sophisticated cranes or lifting equipment. In another embodiment, portable ramps are attached to each set of spine cars in order to facilitate loading and unloading using a hostler truck in the manner noted above.

Conclusion

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is intended that this invention be limited only by the claims and the equivalents thereof.

What is claimed is:

1. A railway terminal, comprising:

a parking area;

an access restriction system adjacent to the parking area, wherein the access restriction system limits access to said parking area; and a railroad track adjacent to the parking area, wherein the railroad track includes a first section, a second section and a loading pad, wherein the first and the second sections each accommodate a plurality of intermodal railcars, each railcar designed to transport a tractor-trailer, wherein the first section is coupled to a main rail line; and wherein the loading pad links the first section of the railroad track to the second section of the railroad track, wherein the loading pad is designed to support tractor-trailers and wherein the loading pad provides access to intermodal railcars in the first and second sections.

2. The railway terminal of claim 1, wherein the access restriction system includes a wireless communication system which provides wireless communication within the railway terminal.

3. The railway terminal of claim 1, wherein the access restriction system comprises an entrance gate and an exit gate.

4. The railway terminal of claim 1, wherein the parking area comprises parking spaces for at least sixty tractor-trailers.

5. The railway terminal of claim 1, wherein the parking area comprises a prepared surface that is capable of supporting fully loaded tractor-trailer trucks with minimal wear.

6. The railway terminal of claim 5, wherein the prepared surface comprises a bottom layer of gravel and a top layer of recycled asphalt.

7. The railway terminal of claim 1, wherein the loading pad is paved.

8. The railway terminal of claim 1, wherein the railroad track comprises a first end coupled to the main line via a first switch and a second end opposite the first end coupled to the main line via a second switch.

9. The railway terminal of claim 1, wherein the loading pad is no less than 300 feet in width to enable loading and unloading of truck trailers concurrently from the first and second railroad track sections.

10. The railway terminal of claim 1, wherein the parking area comprises a road to rail parking area and a rail to road parking area.

11. The railway terminal of claim 1, wherein the parking area comprises a long term parking area.

12. A railway terminal, comprising:

an access restriction system;

a parking area adjacent to the access restriction system;

a railroad track adjacent to the parking area wherein the railroad track is split into a first section, a second section and a loading pad, wherein the first and second sections each accommodate a plurality of intermodal railcars, each railcar designed to transport a truck trailer, wherein the first section is coupled to a main rail line, wherein the loading pad links the first section of the railroad track to the second section of the railroad track and provides access to intermodal railcars in the first and second sections and wherein the loading pad is designed to support fully loaded tractor-trailers; and a run-around track substantially parallel to the railroad track, wherein the run-around track is coupled to the main line at both ends.

13. The railway terminal of claim 12, wherein the access restriction system includes a wireless communication system which provides wireless communication capability within the railway terminal.

14. The railway terminal of claim 12, wherein the first section and the second section of the railroad track are each no less than 2200 feet in length.

15. The railway terminal of claim 12, wherein the parking area includes a road to rail parking area and a rail to road parking area.

16. The railway terminal of claim 12, wherein the parking area includes a rail to rail parking area and a road to road parking area.

17. The railway terminal of claim 12, wherein the loading pad is no less than 300 feet in width to enable loading and unloading of truck trailers concurrently from the first and second railroad track sections.

18. The railway terminal of claim 12, wherein the access restriction system comprises an entrance gate and an exit gate.

19. The railway terminal of claim 12, wherein the parking area comprises parking spaces for at least sixty tractor-trailers.

20. The railway terminal of claim 12, wherein the parking area comprises a prepared surface that is capable of supporting fully loaded tractor-trailer trucks with minimal wear.

21. The railway terminal of claim 20, wherein the prepared surface comprises a bottom layer of gravel and a top layer of recycled asphalt.

22. The railway terminal of claim 12, wherein the loading pad is paved.

23. A method of loading an intermodal train having a plurality of train sections, including a first and a second train section, comprising:

driving the intermodal train onto a single track, wherein the single track includes a first section, a second section and a loading pad and wherein the first section is linked to the second section via the loading pad;

positioning the first train section on the first section of the single track;

separating the first train section from the train;

positioning the second train section on the second section of the single track;

aligning a first portable ramp, on the loading pad, with the first train section;

aligning a second portable ramp, on the loading pad, with the second train section;

loading selected trailers onto rail cars of the first train section via the first portable ramp;

loading selected trailers onto rail cars of the second train section via the second portable ramp;

securing the trailers onto the rail cars of the first and second sections of the train; and coupling the first section of the train with the second section of the train.

24. The method of claim 23, wherein aligning includes coupling and securing the first portable ramp to the first train section and the second portable ramp to the second train section.

25. A method of unloading an intermodal train, comprising:

separating the intermodal train into a plurality of train sections;

positioning the train sections adjacent to a loading pad such that two or more train sections can be unloaded at once;

driving a hostler truck onto the train via the loading pad;

coupling the hostler truck to a trailer;

driving the trailer off of the train; and parking the trailer in a transfer parking location.

26. The method of claim 25, wherein driving a hostler truck onto the train includes positioning a portable ramp adjacent to one of the train sections.

27. An intermodal transportation terminal, comprising:

an access restriction system that selectively restricts access to the intermodal transportation terminal;

a parking area adjacent to the access restriction system, wherein the parking area accommodates a plurality of trailers and provides access to each trailer for pick-up and drop-off;

at least one railroad track adjacent to the parking area, wherein at least one track comprises a plurality of track sections, including a first and a second track section, and wherein at least one track is coupled to a main rail line; and a loading pad which interconnects the first and second track sections, wherein trailers are moved across the loading pad when loaded on rail cars positioned on the first and second track sections.

28. The terminal according to claim 27, wherein the loading pad is designed to support a trailer with minimal wear.

29. The terminal of claim 27, wherein the access restriction system includes a wireless communication system which provides wireless communication within the terminal.

30. The railway terminal of claim 27, wherein the access restriction system comprises an entrance gate.

31. The railway terminal of claim 27, wherein the access restriction system comprises an exit gate.

32. The railway terminal of claim 27, wherein the parking area comprises parking spaces for at least sixty tractor-trailers.

33. The railway terminal of claim 27, wherein the parking area comprises a prepared surface that is capable of supporting fully loaded tractor-trailer trucks with minimal wear.

34. The railway terminal of claim 33, wherein the prepared surface comprises a bottom layer of gravel and a top layer of recycled asphalt.

35. The railway terminal of claim 27, wherein the loading pad is paved.

36. The railway terminal of claim 27, wherein the railroad track comprises a first end coupled to the main line via a first switch and a second end opposite the first end coupled to the main line via a second switch.

37. The railway terminal of claim 27, wherein the loading pad is no less than 300 feet in width to enable loading and unloading of truck trailers concurrently from the first and second railroad track sections.

38. An intermodal transportation terminal, comprising:

an access restriction system;

a parking area, wherein the parking area includes a road to rail parking area and a rail to road parking area;

a first railroad track adjacent to the parking area, wherein the first railroad track comprises a plurality of track sections, including a first track section and a second track section;

a second railroad track substantially parallel to the first railroad track, wherein the second railroad track comprises a plurality of track sections, including a third track section and a fourth track section; and a loading pad which crosses the first and second railroad tracks and which couples the first track section to the second track section and the third track section to the fourth track section, wherein the loading pad provides access to intermodal railcars in the first, second, third and fourth track sections;

wherein the first railroad track and the second railroad track are each coupled to a main rail line.

39. The terminal according to claim 38, wherein the access restriction system includes a wireless communication system that operates within an area of the intermodal transportation terminal.

40. An intermodal transportation terminal, comprising:

an access restriction system;

at least one parking area adjacent to the access restriction system, wherein the at least one parking area is capable of accommodating a plurality of trailers;

at least one railroad track adjacent to the at least one parking, wherein each railroad track is coupled to a main rail line and wherein each railroad track includes a plurality of track sections, including a first track section, a second track section, a third track section and a fourth track section;

a first loading pad coupled between the first and second track sections, wherein the first loading pad provides access to intermodal railcars in the first and second track sections;

a second loading pad coupled between the second and a third track sections, wherein the second loading pad provides access to intermodal railcars in the second and third track sections; and a run around track substantially parallel to the at least one railroad track, wherein the run-around track is coupled to the main rail line.

41. The terminal of claim 40, wherein the access restriction system includes a wireless communication system that operates within the intermodal transportation terminal.

42. The intermodal transportation terminal of claim 40, wherein each railroad track is coupled to the main line via a switch at each end of the railroad track.

43. The intermodal transportation terminal of claim 40, wherein each track section is at least 1000 feet in length.

44. The intermodal transportation terminal of claim 40, wherein the first and third track sections are at least 1000 feet in length and the second track section is at least 2000 feet in length.

45. The intermodal transportation terminal of claim 40, wherein the first and second loading pads are each at least 300 feet in length.

46. The intermodal transportation terminal of claim 40, wherein at least one railroad track is no less than 2300 feet in length.

47. The intermodal transportation terminal of claim 40, wherein the loading pad is reinforced to support fully loaded trailers.

48. The intermodal transportation terminal of claim 47, wherein the loading pad is paved.

49. The intermodal transportation terminal of claim 40, wherein the parking area includes a bottom layer of rock and a top layer of recycled asphalt.

50. The terminal of claim 40, wherein the access restriction system comprises an entrance gate and an exit gate.

51. The terminal of claim 40, wherein the terminal further comprises a track for parking railway engines.

52. The terminal of claim 40, wherein the terminal further comprises a way station.

53. An intermodal transportation system, comprising:

a plurality of terminals, wherein each terminal includes: an access restriction system that selectively restricts access to the terminal;

a parking area adjacent to the access restriction system, wherein the parking area accommodates a plurality of trailers and provides access to each trailer for pick-up and drop-off;

at least one railroad track adjacent to the parking area, wherein the track comprises a plurality of track sections, including a first and a second track section, and wherein the track is coupled to a main rail line; and a loading pad which interconnects the first and second track sections, wherein trailers are moved across the loading pad when loaded on rail cars positioned on the first and second track sections;

an intermodal train having a plurality of rail cars, wherein each rail car accommodates a trailer; and a truck, wherein the truck moves each trailer onto its respective rail car.

54. The system of claim 53, wherein the truck is a hostler equipped to couple to any of a variety of trailers and to move the trailers from the parking area onto the rail cars.

55. The system of claim 53, wherein the system further comprises at least one portable ramp, wherein each ramp can be coupled to a rail car.

* * * * *

UNITED STATES PATENT AND TRADEMARK OFFICE

CERTIFICATE OF CORRECTION

PATENT NO. : 6,439,128 B1 
DATED : August 27, 2002
INVENTOR(S) : Douglas J. Miller and Alan O. Parry It is certified that error appears in the above-identified patent and that said Letters Patent is hereby corrected as shown below:

Column 6,
Lines 29 and 39, delete "60/136,544" and insert -- 09/579,918 -- therefor.

Column 10,
Line 45, delete "406" and insert -- 400 -- therefor.

Signed and Sealed this

Twenty-sixth Day of August, 2003

JAMES E. ROGAN
*Director of the United States Patent and Trademark Office*